US008063785B2

(12) United States Patent
Sacchetti

(10) Patent No.: US 8,063,785 B2
(45) Date of Patent: Nov. 22, 2011

(54) HEAD GATCH ALARM SYSTEM

(75) Inventor: Peter J. Sacchetti, Attleboro, MA (US)

(73) Assignee: Alcor Scientific, Inc. a Rhode Island corporation, Warwick, RI (US)

( * ) Notice: Subject to any disclaimer, the term of this patent is extended or adjusted under 35 U.S.C. 154(b) by 254 days.

(21) Appl. No.: 12/556,355

(22) Filed: Sep. 9, 2009

(65) Prior Publication Data

US 2010/0060463 A1 Mar. 11, 2010

Related U.S. Application Data

(60) Provisional application No. 61/095,646, filed on Sep. 10, 2008.

(51) Int. Cl.
*G08B 23/00* (2006.01)

(52) U.S. Cl. ..... 340/573.7; 340/573.1; 340/539.12

(58) Field of Classification Search ..... 340/573.7, 340/573.1, 539.12; 33/366.11; 5/600, 613, 5/617

See application file for complete search history.

(56) References Cited

U.S. PATENT DOCUMENTS

| | | | | |
|---|---|---|---|---|
| 4,348,562 | A | 9/1982 | Florin | |
| 4,547,972 | A | 10/1985 | Heidel et al. | |
| 5,199,122 | A | 4/1993 | Styblo | |
| 5,611,096 | A | 3/1997 | Bartlett et al. | |
| 5,941,836 | A | 8/1999 | Friedman | |
| 6,611,783 | B2 | 8/2003 | Kelly, Jr. et al. | |
| 6,640,246 | B1 | 10/2003 | Gary, Jr. et al. | |
| 6,742,993 | B2 | 6/2004 | Savard et al. | |
| 6,892,405 | B1 | 5/2005 | Dimitriu et al. | |
| 7,017,211 | B2 | 3/2006 | Krywiczanin et al. | |
| 7,030,764 | B2 | 4/2006 | Smith et al. | |
| 7,052,474 | B2 | 5/2006 | Castell et al. | |
| 7,117,607 | B2 | 10/2006 | Horgan | |
| 7,127,370 | B2 | 10/2006 | Kelly, Jr. et al. | |
| 7,487,562 | B2 * | 2/2009 | Frondorf et al. | 5/613 |
| 7,562,458 | B1 * | 7/2009 | Clark et al. | 33/333 |
| 2001/0041861 | A1 | 11/2001 | Gobel | |
| 2007/0143920 | A1 | 6/2007 | Frondorf et al. | |
| 2007/0268480 | A1 | 11/2007 | Kaye | |
| 2008/0086076 | A1 | 4/2008 | Gerber | |
| 2008/0146994 | A1 | 6/2008 | Gerber | |
| 2008/0171963 | A1 | 7/2008 | Gerber | |

FOREIGN PATENT DOCUMENTS

| | | | |
|---|---|---|---|
| WO | 2006015053 | A1 | 2/2006 |

* cited by examiner

*Primary Examiner* — Toan N Pham

(74) *Attorney, Agent, or Firm* — Barlow, Josephs & Holmes, Ltd.

(57) ABSTRACT

A head gatch alarm system reduces medical risk for aspirational pneumonia when an angle of the head gatch section is outside a predetermined range. The system includes an inclinometer and a pump. The inclinometer is attached to the head gatch section for sensing an angle of the head gatch section. The inclinometer includes an RF receiver and RF transmitter for sending and receiving signals to a pump. An alarm or other means for alerting a medical professional is in communication with the inclinometer or the pump. The pump includes an RF transmitter and RF receiver for two way RF communication between the pump and the inclinometer. In operation, the alarm is triggered and the pump is turned off when the head gatch section is positioned outside a predetermined range.

22 Claims, 6 Drawing Sheets

ALARM – Recieves pump running signal AND inclined <45°
BEEPING/FLASHING

ALARM – Recieves pump running signal AND inclined >45°
SILENT

HEAD GATCH ALARM SYSTEM

CROSS REFERENCE TO RELATED APPLICATION

This application is related to and claims priority from earlier filed provisional patent application Ser. No. 61/095,646 filed Sep. 10, 2008, the entire contents of which are incorporated herein by reference.

BACKGROUND OF THE INVENTION

The present invention generally relates to a head gatch alarm system, more specifically, relates to a device, methods and system for a head gatch alarm system that triggers an operational response and an alert of a medical risk for aspirational pneumonia when an enteral pump is delivering liquid nutrients to a patient and an angle of the head gatch section is outside a predetermined range.

While the use of an enteral feeding pump is a common device for delivering a liquid nutrient to a patient, complications can arise during the feeding. In particular, one of these complications is aspirational pneumonia. Typically, aspirational pneumonia occurs when a patient's bed is positioned at an angle sufficient to allow the patient's gastric fluids to ascend the esophagus and be inhaled into the lungs. When the bed angle reaches this point, the stomach contents are able to percolate up through the esophagus and down into the lungs. When the enteral feeding pump continues to deliver liquid nutrients, despite the undesired low bed angle, it increases the medical risk of aspirational pneumonia.

Therefore, there remains a need in the prior art for a head gatch alarm system that reduces the risk of aspirational pneumonia with minimal false alarms or errors. More importantly, there is a need for a head gatch alarm system that alerts of a medical risk of aspirational pneumonia while allowing a medical professional to determine when to shut off a pump delivering vital liquid nutrients to a patient.

BRIEF SUMMARY OF THE INVENTION

The invention preserves the advantages of prior head gatch alarm systems. In addition, it provides new advantages not found in currently available head gatch alarm systems and overcomes many disadvantages of such currently available head gatch alarm systems. The present invention provides a head gatch alarm system that triggers an alert of a medical risk for aspirational pneumonia when an enteral pump is delivering liquid nutrients to a patient and an angle of the head gatch section is outside a predetermined range.

A head gatch alarm system triggers an operational response and an alert of a medical risk for aspirational pneumonia when an enteral pump is delivering liquid nutrients to a patient and an angle of the head gatch section is outside a predetermined range. The system may include a bed frame having a head gatch section, an inclinometer, a pump, and a means for triggering an alert. An inclinometer is removably or permanently attached to the head gatch section for sensing an angle of the head gatch section. The inclinometer includes an RF receiver and RF transmitter for sending and receiving RF or wireless signals to a pump. An example of a means for triggering an alert is an alarm or display of the operational status of the pump or the inclinometer. An alarm is in electrical or wireless communication with the inclinometer or the pump. An example of an operational response is the shutting off of the pump or other means for prevention of flow of liquid nutrients to the patient. The pump includes an RF transmitter and RF receiver for two way RF communication between the pump and the inclinometer. In operation, the alarm is triggered and the pump is turned off when the head gatch section is positioned outside a predetermined range.

The present invention includes a device for triggering an operational response and an alert of a medical risk of aspirational pneumonia which can be attached or retrofitted to an existing bed frame. The device includes an inclinometer, pump, and a means for triggering an alert. The inclinometer is used for sensing an angle of the head gatch section. The inclinometer includes an RF receiver and RF transmitter for sending and receiving RF signals to a pump. The means for triggering an alert, by example, may include an alarm or display is in electrical communication with the pump, the inclinometer, or both. An example of a means for triggering an alert is an alarm or display of the operational status of the pump or the inclinometer. The pump includes an RF transmitter and RF receiver for two way RF communication between the pump and the inclinometer. In operation, the alarm is triggered and pump is turned off when the head gatch section is positioned outside a predetermined angle range.

The present invention also includes a method for triggering an operational response and an alert of a medical risk of aspirational pneumonia. First, an inclinometer is removably or permanently attached to a head gatch section of a bed frame. The inclinometer includes an RF transmitter and RF receiver for sending and receiving RF signals to a pump. Second, a pump for delivery liquid nutrient to a patient is provided which includes an RF transmitter and RF receiver for sending and receiving signals from the inclinometer. Third, the pump and the inclinometer are activated for operation. Fourth, the angle of the head gatch section of the bed frame is sensed by the inclinometer automatically. Fifth, an RF signal is sent from the pump to the inclinometer when the pump is delivering a liquid nutrient to a patient. Sixth, an alarm is triggered and the pump is turned off when an RF signal from the pump is received by the inclinometer indicating the enteral pump is delivering the liquid nutrient and the angle sensed by the inclinometer is positioned outside a predetermined range.

It is therefore an object to provide an alert of a medical risk for aspirational pneumonia.

It is another object to control the operation of a pump when a patient has a medical risk for aspirational pneumonia.

A further object is to deliver nutrients to a patient when the head gatch section is within a predetermined angular range to reduce the risk of aspirational pneumonia.

Another object is to provide a safe and effective way for feeding patients using an enteral pump.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENTS

In accordance with the invention of FIGS. 1-6, the invention generally relates to a head gatch alarm system 10, more specifically, relates to a device, methods and systems for a head gatch alarm system 10 that triggers an alert of a medical risk for aspirational pneumonia when an enteral pump 30 or enteral pump assembly is delivering liquid nutrients to a patient and an angle of the head gatch section 105A of a bed frame 105 is outside a predetermined range.

In accordance with the present invention, a new head gatch alarm system 10 is disclosed that triggers an alert of a medical risk for aspirational pneumonia and an operational response when an enteral pump is delivering liquid nutrients to a patient and an angle of the head gatch section is below a predetermined range. The head gatch alarm system 10 reduces the risk of aspirational pneumonia with minimal false alarms or errors. More importantly, the head gatch alarm system 10 alerts of a medical risk for aspirational pneumonia while allowing a medical professional to determine when to attend to a pump delivering vital liquid nutrients to a patient. Also, the operational response may include shutting off the pump, shutting off the inclinometer, or both when the angle of the head gatch section is below a predetermined range.

Figure 1:
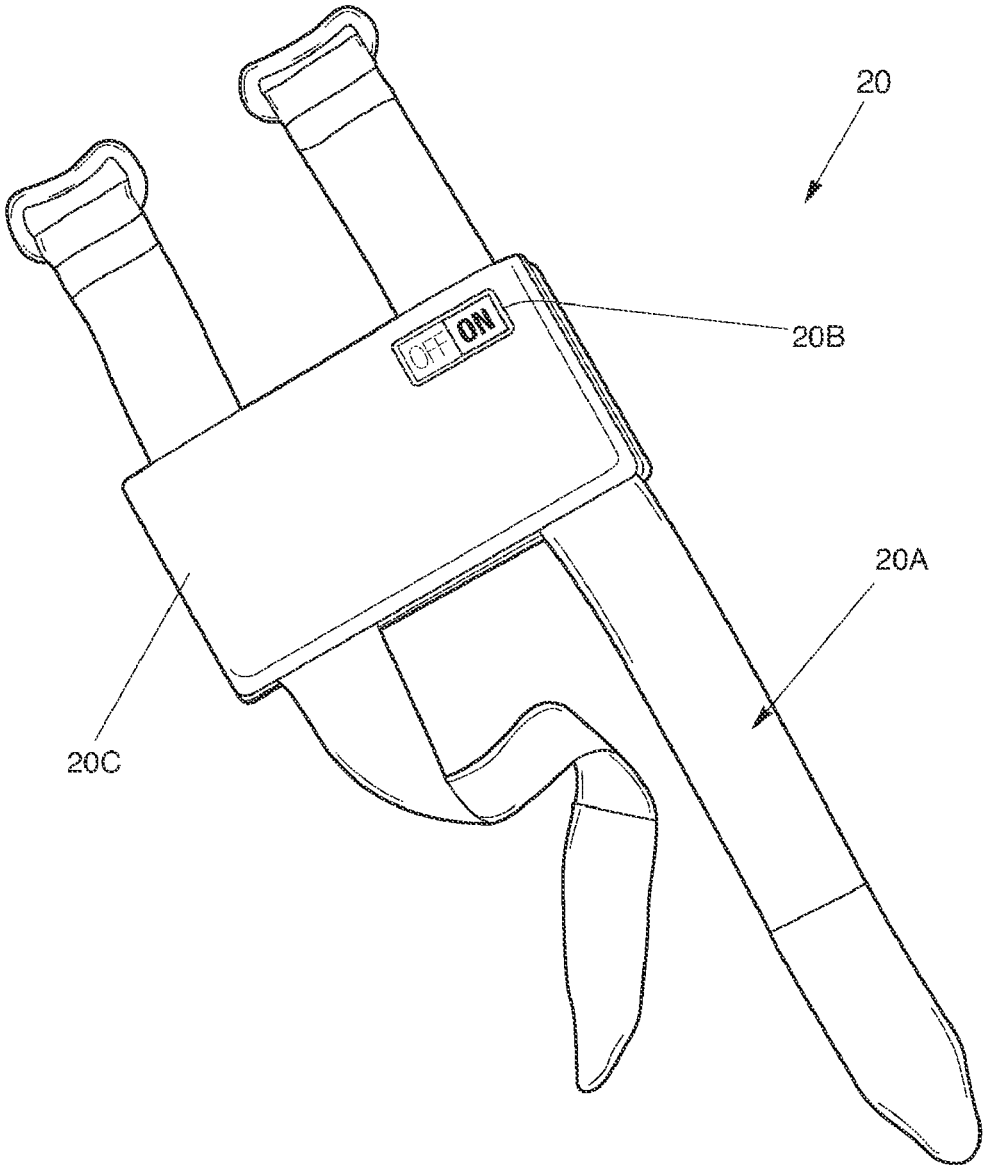
FIG. 1 is a perspective view of a removable inclinometer used in the present invention.
Figure 2:
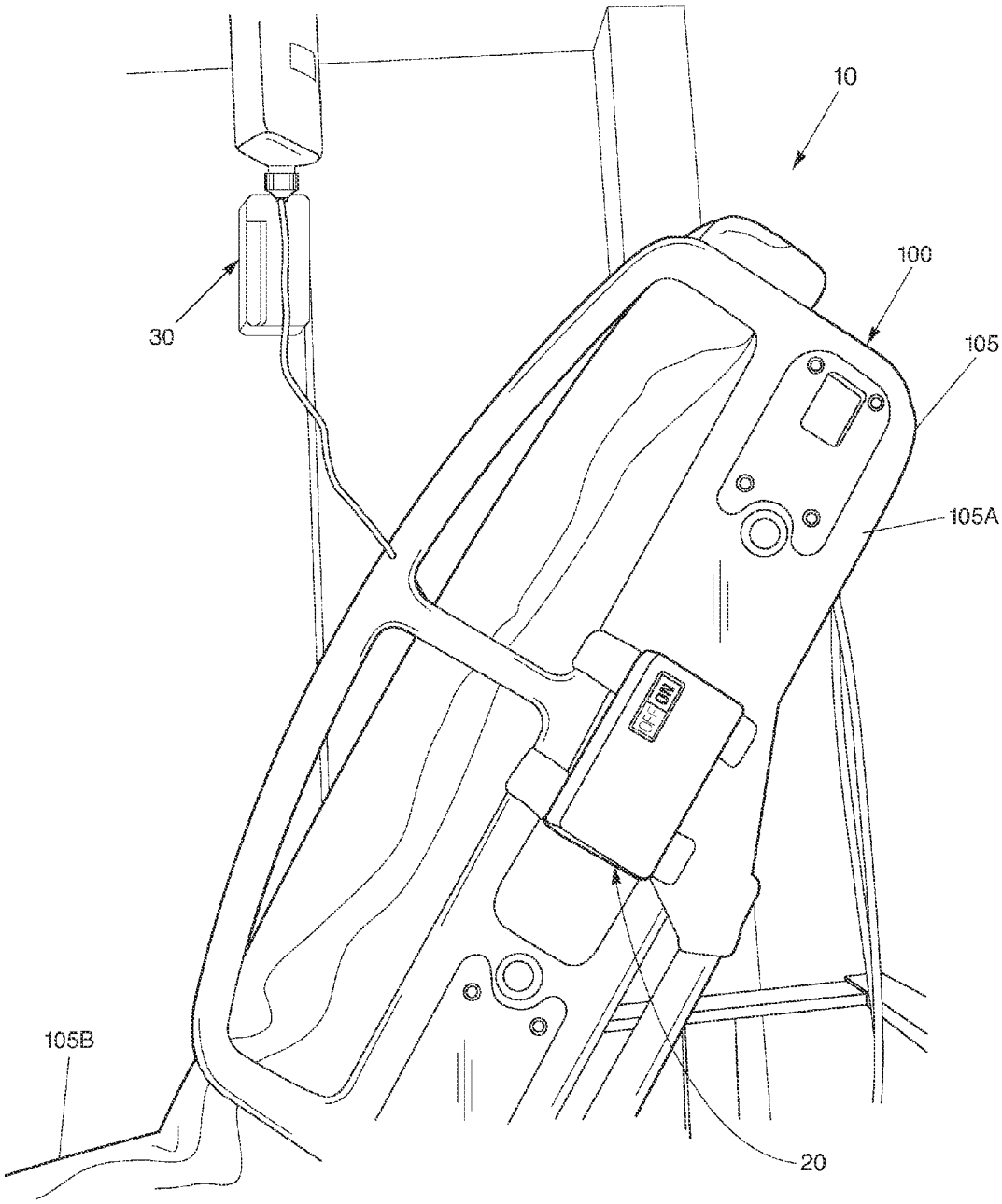
FIG. 2 is a perspective view of the present invention including a pump and the inclinometer removably attached to a bed frame.

As illustrated in FIGS. 1-2, the head gatch alarm system 10 includes an inclinometer 20, a means for alerting of a medical risk of aspirational pneumonia or an operational response to a medical risk of aspirational pneumonia, and an enteral pump 30. Preferably, the head gatch alarm system 10 is used in conjunction with an adjustable bed 100 known in the prior art in a health care setting. The adjustable bed 100 contains usually a bed frame 105 with a head gatch section 105A and a base section 105B. The head gatch section 105A moves from a horizontal plane to a vertical plane relative to the base section 105B. The angle of the head gatch section 105A may range from 0-5 degrees where the patient is lying flat on the bed and positioned on a substantially horizontal plane, to 40-45 degrees where the patient is in a middle position, and to 85-90 degrees where the patient is positioned on a substantially vertical plane in a substantially upright position. The head gatch section 105A provides support to a patient's head and upper body region while the base section 105B provides support to the legs and lower body of a patient.

The head gatch alarm system 10 triggers an alert of a medical risk for aspirational pneumonia and an operational response when an enteral pump 30 is delivering liquid nutrients to a patient and an angle of the head gatch section 105B is outside a predetermined range, which will be discussed further below. The head gatch alarm system 10 may include a bed frame 105 having a head gatch section 105A. An inclinometer 20 is attached to the head gatch section 105A for sensing an angle of the head gatch section 105A relative to the base section 105B. The inclinometer 20 may be permanently attached or removably attached. As illustrated in FIGS. 1-2, the inclinometer 20 may be in the form a self-contained bed module for removable attachment to the bed frame by a medical professional. Alternatively, as illustrated in FIG. 3, the inclinometer may be permanently attached to the bed frame at a desirable position.

Figure 3:
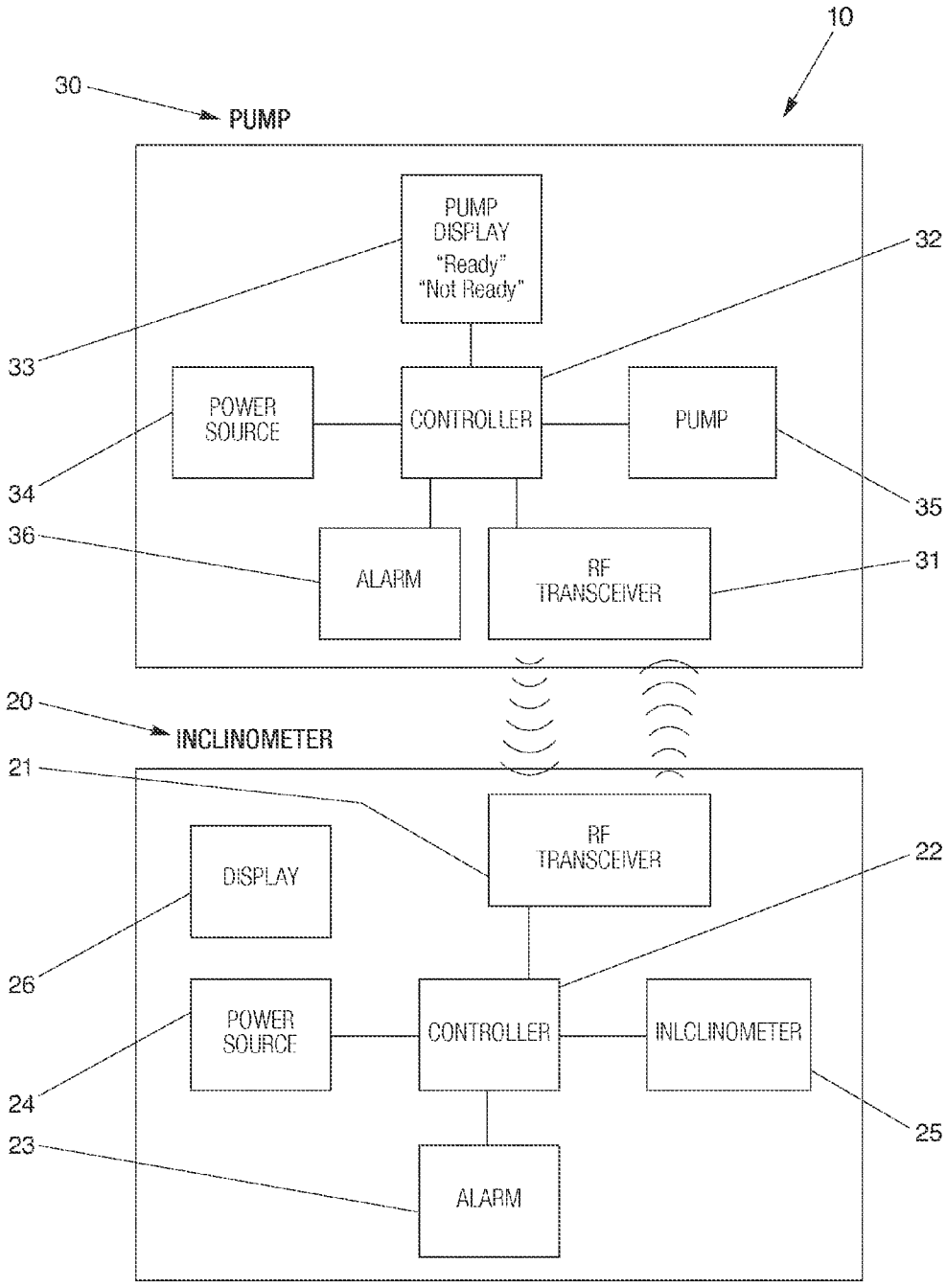
FIG. 3 is a schematic drawing of the operational components of the present invention.

Referring to FIG. 3, the head gatch alarm system 10 further includes an inclinometer 20 and a pump 30. The inclinometer 20 includes an RF transmitter, RF receiver, a controller 22, an angle sensor 25, a power source 24, a display 26, and an alarm 23. The RF receiver and RF transmitter are used for sending and receiving signals to a pump wirelessly. In one embodiment, RF receiver and RF transmitter are combined into an RF transceiver 21. The controller 22 operates the RF sending and receiving of signals to the pump 30, angle sensor 25 or inclinometer, power source 24, display 26 for indicating status of operation, and alarm 23. The angle sensor 25 is used to determine the angled position of the head gatch section 105A of the bed frame 105. The alarm 23 and display 26 are in electrical communication with the controller 22 or the pump 30 to alert a medical professional when the head gatch section 105A is outside a predetermined range.

The pump 30 of the head gatch alarm system 10 includes a controller 32, a RF transceiver 31, a power source 34, a pump 35 including a pump motor, and a pump display 33 for indicating status of operation. The RF transceiver 31, or RF transmitter/receiver, is configured for two way RF communication between the pump 30 and the inclinometer 20. The pump display 35 is in electrical communication with the controller 32. When an RF signal is received from the inclinometer 25 that the head gatch section 105A is positioned outside a predetermined range, the pump 30 is turned off. Also, when an RF signal is received by the inclinometer 20 that the head gatch section 105A is positioned outside a predetermined range and the pump 30 is no longer in operation, the inclinometer 20 may be shut off.

A device for triggering an alert of a medical risk of aspirational pneumonia can be attached to existing bed frames. The device includes an inclinometer 20 for sensing an angle of the head gatch section 105A, a pump 30, and a means for an operational response and alerting a medical professional. The inclinometer 20 includes a transceiver 21 for sending and receiving RF signals to a pump 30. An alarm 23 and display 26 is in electrical communication with the controller 22. A pump 35 is in communication with the controller 32. The pump 30 includes an RF transceiver 31 for two way RF communication between the pump 30 and the inclinometer 20. In operation, the alarm 23 is triggered and pump 30 is turned off when the head gatch section 105A is positioned outside a predetermined angle range.

With regard to a bed module of the inclinometer 20, as shown in FIG. 1, the inclinometer 20 may include a central housing 20C with adjustable straps 20A attached thereto. The adjustable straps 20A with buckles are one example of attaching the inclinometer 20 to the bed frame 105. The adjustable straps 20A have a length sufficient to attach to the width of the bed frame 105. Other means for attaching the inclinometer 20 to the bed frame may include: hook/loop fasteners, adhesive materials, buttons, and other fastening hardware or means known in the art.

The inclinometer 20 is preferably attached to the bed frame at a position sufficient for communicating with an enteral pump 30. It is possible that the inclinometer 20 is also attached directly or indirectly to the patient alone, or directly or indirectly to the patient and the bed frame 105. The inclinometer 20 comprises any mechanism for sensing an angle of a bed, patient, or both a bed and a patient simultaneously. The inclinometer 20 may be adjustable to select the predetermined range that is desirable for the angle of the head gatch section 105A. A wide range of inclinometers known in the prior art may be used in the present invention. The inclinometer 20 may sense the actual angle of the bed frame 105, or alternatively, identify when the bed frame 105, patient, or both is below a desired angle. In one embodiment, the inclinometer 20 is attached to the side bed rails of the head gatch section 105A or the underside of the head gatch section 105A.

As indicated, the inclinometer 20 may be wireless and contain a wireless transmission devices for sending and receiving a signal from other devices, including a pump 30. In one embodiment, the inclinometer includes a RF (radio frequency) receiver and RF transmitter for sending and receiving signals from other devices, such as an enteral pump 30. It is also contemplated that a transceiver, capable of both transmitting and receiving signals, may be used in the inclinometer. Also, an RF signal is representative of one form of wireless communication. Some other forms of wireless communication may include microwave communication, infrared (IR) short-range communication, WIFI, and Bluetooth. The RF communication between the pump 30 and the inclinometer 20 may be facilitated by use of a WAN, LAN, or other type of network, computer, or electrical device for communication.

The inclinometer 20 may have a power source 24, such as a battery, integrated within the central housing 20B making the inclinometer 20 cordless. Alternatively, it may have an external source of power, such as a power outlet, which is connected via a cord. Also, the inclinometer 20 may be powered by wireless energy transfer whereby energy is transmitted from a power source 24 to the inclinometer 20, without interconnecting wires or batteries.

The means for alerting a medical professional or patient is in response to when the head gatch section 105A is positioned outside a predetermined range and the pump is delivery fluid to the patient. The alerting mechanisms may be contained within the inclinometer 20 or, alternatively, separate and apart from the inclinometer 20 but in communication with the inclinometer 20. Preferably, the alarm 23 or display 26 is contained within the inclinometer 20. For example, an alarm 23 may sound when a medical risk occurs. The alarm may include a bell, whistle, horn, blinking light, textual display on a monitor, or other sounding or visual device. Alternatively, the means for alerting may include a remote signal communicated via computer, phone, electronically, radio signal, network device, or wirelessly that provides notice of a medical risk of aspirational pneumonia. The alarm 23 or display 26 may be in electrical or wireless communication with the inclinometer 20 to provide a local alarm, audio or visual, to alert an on-site medical professional when the head gatch section 105A is outside a predetermined range. Alternatively, the alarm 23 may be a remote alarm, audio or visual, to alert an off-site medical professional when the head gatch section 105A is outside a predetermined range. It should be noted that these are merely examples of alarms and displays and there are many more options that may be utilized.

The means for alerting a medical professional or patient may be directed or specially configured for a person or device, which monitors or responds to a medical risk of aspirational pneumonia. For example, the person alerted may include a nurse, doctor, patient, spouse, family member, or other types of caregivers. The device may include other computers which monitor and alert others of a medical risk, or alternatively, respond directly to the medical risk by taking action with regard to the bed, alarm, enteral pump, or other devices connected to or contacting the patient. For example, the means for alerting may include alerting a remote monitoring device or computer. It should be noted that these are merely examples and not intended to be exhaustive list of all possible ways of responding to medical emergencies.

The head gatch alarm system 10 also contains an enteral pump 30 positioned about the bed frame, and in particular, in a position that facilitates proper communication between the enteral pump 30 and the inclinometer 20. In one embodiment, the enteral pump 30 is attached to a wall above the bed and the inclinometer 20 is attached to the underside of the head gatch section of the bed frame. Of course, there are multiple positions for arranging the enteral pump 30 and inclinometer 20 beyond those mentioned above.

The enteral pump 30 is one known in the prior art which pumps liquid nutrients from a liquid supply, through a tubing set, and into a patient. Many means for connecting the patient to the enteral pump 30 is known in the art. The enteral pump 30 may also include a display 33 for indicating operational status, visually, of the enteral pump 30. The pump 30 may also include an alarm 36 or display 33, audio or visual, to alert a medical professional or patient when the head gatch section 105A is outside a predetermined range as directed by the controller 32. In one embodiment, the display 33 includes a status of "ready" or "not ready" for the medical professional or patient.

The enteral pump 30, in one embodiment, is in communication with an electrical controller for controlling the operation of the pump 35. The pump 30 includes an RF transmitter and RF receiver or transceiver 31 for two-way RF communication between the pump 30 and the inclinometer 20. The pump 30 may also communicate wirelessly using infrared, Bluetooth, or other wireless methods. The pump 30 has a transceiver 31 for sending signals to the transceiver 21 of the inclinometer 20 when the enteral pump is delivering a liquid nutrient to a patient. The pump 30, when not delivering liquid nutrients to the patient, communicates the wireless or RF signal to the transceiver 21 of the inclinometer 20. Also, it should be noted that the pump 30 may transmit a signal to the transceiver 21 of the inclinometer 20 when the enteral pump 30 is turned on, or not transmit a signal to the transceiver 21 of the inclinometer 20 when the enteral pump 30 is turned off. Alternatively, the inclinometer 20 may transmit a continuous wireless signal requesting status of the pump 30. It is contemplated that the pump 30 and the inclinometer 20 are in continuous wireless communication to provide relevant information concerning the pump 30, the inclinometer 20, the head gatch section 105A, and fluid flow and delivery rates of liquid nutrients to the patient via the tube delivery set connected to the pump 30. The inclinometer 20 may also awaken or activate the pump 30 when the inclinometer power button 20B is turned on.

Figure 4:
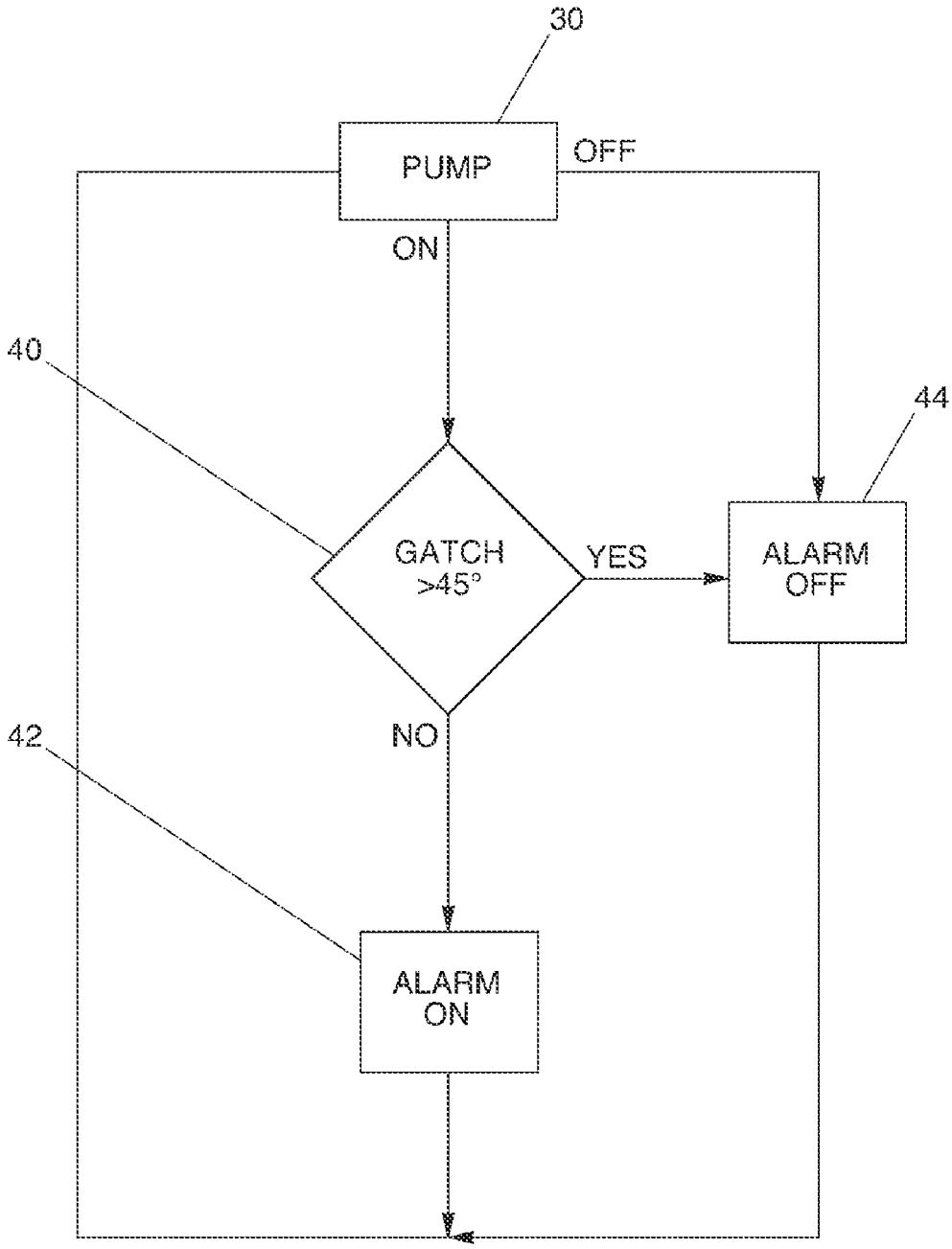
FIG. 4 is a flow chart of the present invention including operation of pump and alarm relative to head gatch angle.

Referring to FIG. 4, in operation, the means for alerting of a medical risk of aspirational pneumonia and operational response is triggered and employed when the enteral pump 30 is delivering a liquid nutrient to a patient via a tube delivery set or other means and the head gatch section 105A is positioned outside a predetermined range. Note, the means for alerting of a medical risk and operational response, such as shutting of the pump, may also be triggered when either both or one of these events occur. In one embodiment, the predetermined range of the head gatch section 105A is approximately 45 degrees to 90 degrees 40 relative to the base section 105B. In some cases, the predetermined range of the head gatch section may range from approximately 30 degrees to 90 degrees. Within this predetermined range from 45 degrees to 90 degrees, the patient's risk of aspirational pneumonia is reduced. For example, if the head gatch section is positioned at approximately less than 45 degrees relative to the base section, then the inclinometer 20 will sense that that the head gatch section 105A is positioned outside a predetermined range.

If the enteral pump 30 is delivering liquid nutrient, when the head gatch section 105A is positioned outside a predetermined range, then the means for alerting of a medical risk of aspirational pneumonia will be triggered 42. The enteral pump 30 transmits RF signals or other wireless signals to the inclinometer 20 when the enteral pump 30 is delivering liquid nutrient. When the inclinometer 20 receives the RF signal from the pump 30 and senses that the head gatch section 105A is positioned outside a predetermined range, and then the means for alerting of a medical risk will be triggered. It is contemplated that the system may be adjusted to allow for triggering an alert when the head gatch section or position 105A alone is outside the predetermined range.

If the enteral pump 30 is not delivering liquid nutrient, when the head gatch section 105A is positioned outside the predetermined range, then the means for alerting of a medical risk may not be triggered. When the enteral pump 30 is not delivering liquid nutrient, the pump 30 is not transmitting an RF signal to the inclinometer 20. In the absence of an RF signal from the enteral pump 30, the means for alerting of a medical risk will not be triggered. Alternatively, the inclinometer 20 may send an RF signal to the controller requesting the status of the pump 30 on a continuous basis and when the pump 30 is not operational, the means for alerting of a medical risk may not be triggered 44.

Figure 5A:
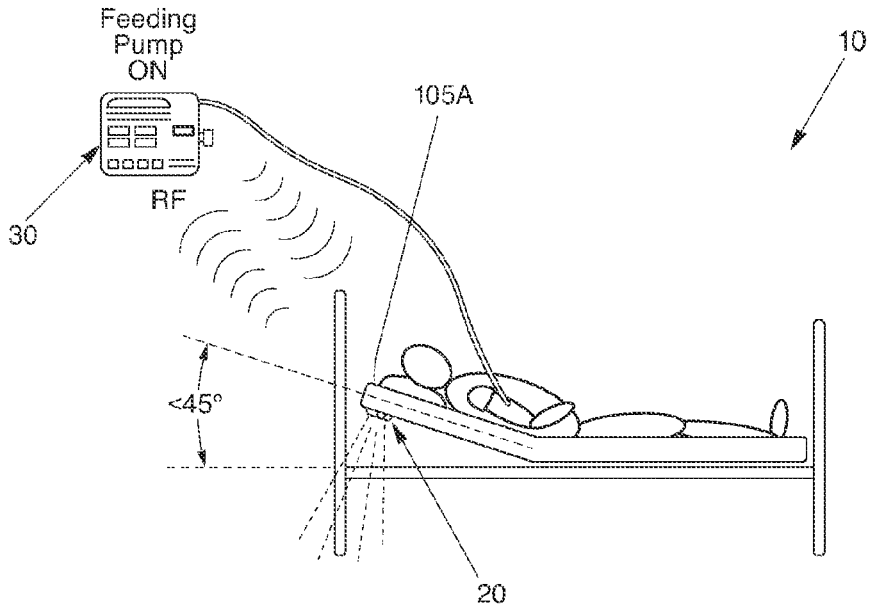
FIG. 5A is a side view of the present invention including the pump and the inclinometer when the alarm is triggered.
Figure 5B:
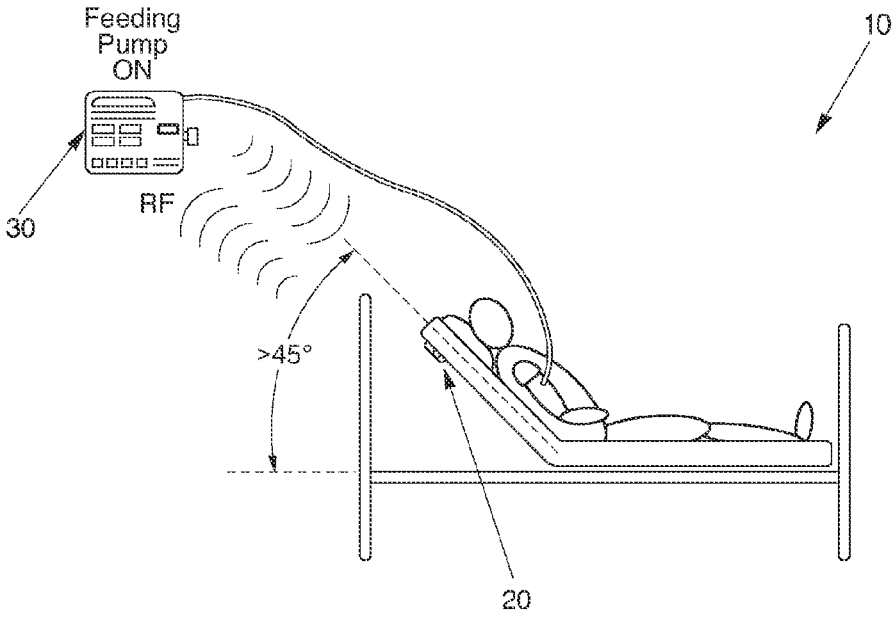
FIG. 5B is a side view of the present invention including the pump and the inclinometer when the alarm is silent.

Referring to FIGS. 5A-5B, once the means for alerting is triggered or activated, the alert may be stopped by either moving the head gatch into a position within the predetermined range of 45 degrees to 90 degrees or stopping the delivery of liquid nutrients by the enteral pump or both. Upon being alerted, a person or device may move the head gatch section 105A into a position within the predetermined range. Also, the person or device may stop the delivery of the liquid nutrients by shutting down the enteral pump 30 or preventing the flow of liquid nutrients. Alternatively, the enteral pump 30 may be turned off automatically when the inclinometer 20 and is no longer communicating or are not communicating the proper conditions to continue pumping. Once either of the two events occur, moving the head gatch section 105A into a predetermined range or stopping the delivery of liquid nutrients by an enteral pump 30, then the means for alerting will be stopped and the operational response will be overridden.

The present invention also includes a method for alerting of a medical risk for aspirational pneumonia. The method includes sensing the angle of a head gatch section 105A of a bed frame using an inclinometer 20 having an RF transmitter and receiver removably or permanently attached to the bed frame 105. Next, an RF or wireless signal is transmitted from an enteral pump 30 having an RF transmitter and RF receiver to the inclinometer 20 having a RF transmitter and RF receiver when the enteral pump 30 is delivering a liquid nutrient to a patient. When a wireless or RF signal from the pump 30 is received by the inclinometer 20 indicating the enteral pump is delivering the liquid nutrient and the angle of the head gatch section 105A is positioned outside a predetermined range, as noted above, a means for alerting of a medical risk of aspirational pneumonia or operational response, such as an alarm or display or shutting of pump 30, is triggered. When the RF or wireless signal from the enteral pump 30 to the inclinometer 20 has stopped, indicating that enteral pump 30 is not delivering a liquid nutrient, the means for alerting of a medical risk is stopped. Also, when the head gatch section 105A is positioned within a predetermined range, preferably between 45 degrees and 90 degrees, the means for alerting of a medical risk for aspirational pneumonia is stopped.

Figure 6:
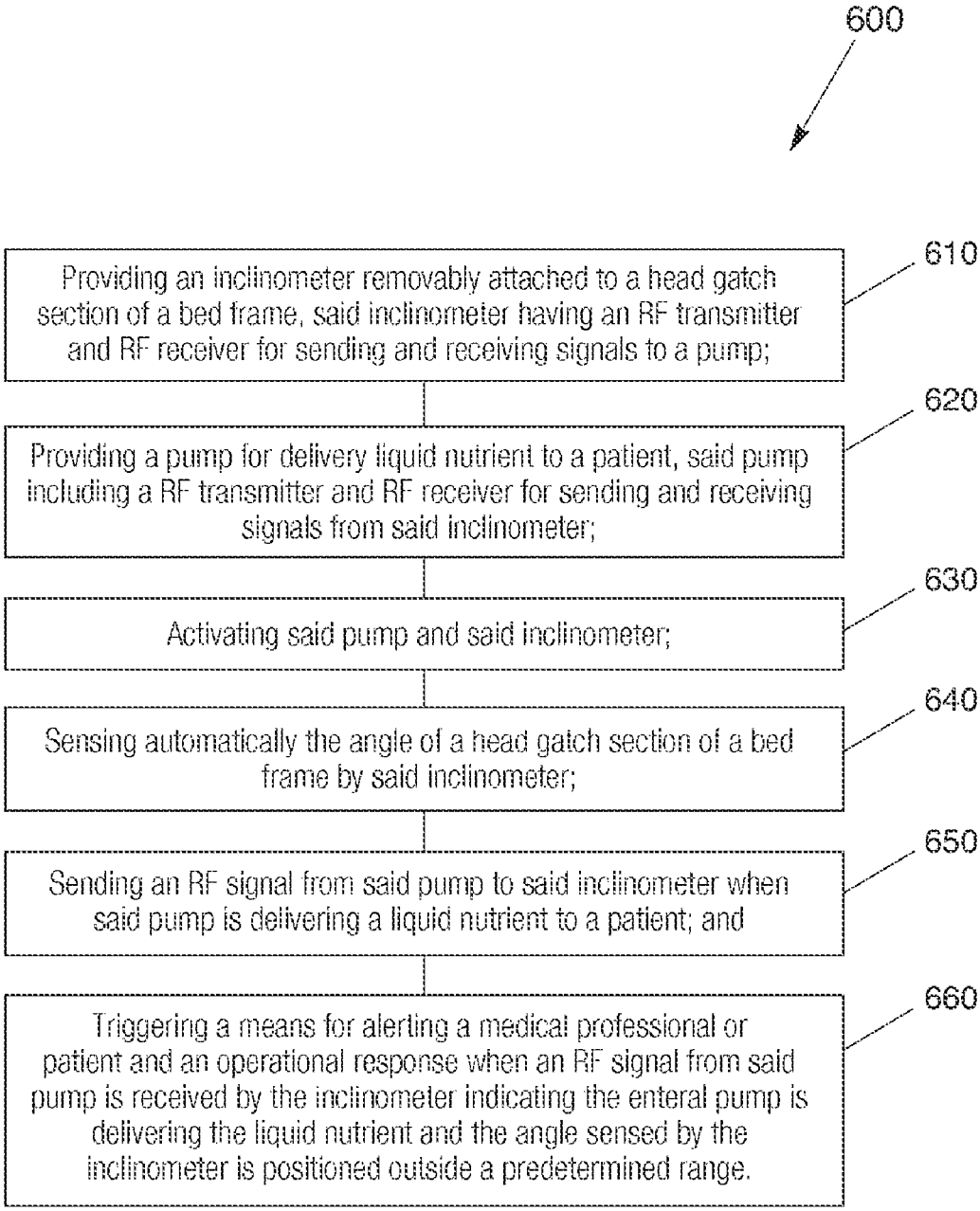
FIG. 6 is a block diagram of the method of the present invention.

Referring to FIG. 6, the present invention also includes another method for triggering an alert of a medical risk of aspirational pneumonia and an operational response 600. First, an inclinometer is removably or permanently attached to a head gatch section of a bed frame 610. The inclinometer includes an RF transmitter and RF receiver for sending and receiving RF signals to a pump. Second, a pump for delivery liquid nutrient to a patient is provided which includes an RF transmitter and RF receiver for sending and receiving signals from the inclinometer 620. Third, the pump and the inclinometer are activated for operation 630. Fourth, the angle of the head gatch section of the bed frame is sensed by the inclinometer automatically 640. Fifth, an RF signal is sent from the pump to the inclinometer when the pump is delivering a liquid nutrient to a patient 650. Sixth, an alarm is triggered and the pump is turned off when an RF signal from the pump is received by the inclinometer indicating the enteral pump is delivering the liquid nutrient and the angle sensed by the inclinometer is positioned outside a predetermined range 660.

The method of the present invention includes an operational response. The operational response occurs when the head gatch section 105A is positioned outside a predetermined range. An operational response may include shutting off pump 30 when RF signal from said inclinometer 20 indicates the angle sensed by the inclinometer 20 is positioned outside a predetermined range. Another operational response is an RF signal sent from said inclinometer 20 to the pump 30 instructing said pump 30 to shut off. A further operational response is an RF signal sent from the pump 30 to the inclinometer 20 instructing the inclinometer 20 to shut off.

The method of the present invention further includes a means for alerting a medical professional or patient. The means for alerting may include a display 26, 33 in communication with the pump 30 or inclinometer 20 indicating the operational status of the pump 30, the inclinometer 20, or both. A further alert may include an alarm 23, 36 in communication with the pump 30, the inclinometer 20, or both.

The method of the present invention further includes turning off the alarm 23, 36 and turning on the pump 30 when the head gatch section is positioned at an angle with a predetermined range. The alarm 23, 36 may be turned off when RF signal from the pump 30 to the inclinometer 20 indicates that the pump 30 is not delivering a liquid nutrient. The alarm 23, 36 may be turned off when the inclinometer 20 senses that the head gatch section 105A is within a predetermined range. The pump 30 is turned on when an RF signal from said inclinometer 20 to said pump 30 indicates that said head gatch section 105A is positioned within a predetermined range.

The activation, awakening, or powering on of the inclinometer 20 and the pump 30 may occur by a variety of manual or automatic methods. The inclinometer 20 may be activated by manually switching the power on. The inclinometer 20 may be activated by automatically when an RF signal is received from the pump 30 indicating that the pump 30 is delivering liquid nutrients to the patient. The pump 30 may be activated by manually turning the power on. The pump 30 may be automatically turned on or activated when an RF signal from the inclinometer 20 indicates that said head gatch section 105A is within a predetermined angular range.

In view of the foregoing, a new and novel head gatch alarm system 10 is provided that triggers an alert of a medical risk for aspirational pneumonia and an operational response when an enteral pump 30 is delivering liquid nutrients to a patient and an angle of the head gatch section 105 is below a predetermined range. The head gatch alarm system 10 of the present invention reduces false alarms.

It would be appreciated by those skilled in the art that various changes and modifications can be made to the illustrated embodiments without departing from the spirit of the present invention. All such modifications and changes are intended to be within the scope of the present invention.

What is claimed is:

1. A device, comprising:

an inclinometer removably attached to a head gatch section of a bed frame for sensing an angle of the head gatch section, the inclinometer including an RF receiver and RF transmitter for sending and receiving RF signals to a pump;

said pump in RF communication with said inclinometer, said pump including an RF transmitter and RF receiver for two way RF communication between said pump and said inclinometer; and a means for an operational response and alerting a medical professional or patient in communication with said pump, said inclinometer, or both;

wherein the means for alerting the medical professional and an operational response is triggered when said head gatch section is positioned outside a predetermined angle range.

2. The device of claim 1, wherein said means for alerting is a display in communication with said pump, said inclinometer, or both.

3. The device of claim 1, wherein said means for alerting is an alarm in communication with said pump, said inclinometer, or both.

4. The device of claim 1, wherein said operational response is an RF signal from said inclinometer to instructing said pump to shut off.

5. The system of claim 4, wherein said means for alerting is a display in communication with said pump, said inclinometer, or both.

6. The system of claim 4, wherein said means for alerting is an alarm in communication with said pump, said inclinometer, or both.

7. The system of claim 4, wherein said operational response is an RF signal sent from said inclinometer to said pump instructing said pump to shut off.

8. The system of claim 4, wherein said operational response is an RF signal sent from said pump to said inclinometer instructing said inclinometer to shut off.

9. A system, comprising:

a bed frame including a head gatch section;

an inclinometer removably attached to a head gatch section of a bed frame for sensing an angle of the head gatch section, the inclinometer including an RF receiver and RF transmitter for sending and receiving RF signals to a pump;

said pump in RF communication with said inclinometer, said pump including an RF transmitter and RF receiver for two way RF communication between said pump and said inclinometer; and a means for an operational response and alerting a medical professional or patient in communication with said pump or said inclinometer;

wherein the means for alerting the medical professional or patient and operational response is triggered when said head gatch section is positioned outside a predetermined angle range.

10. A method, comprising:

Providing an inclinometer removably attached to a head gatch section of a bed frame, said inclinometer having an RF transmitter and RF receiver for sending and receiving signals to a pump;

Providing the pump for delivery liquid nutrient to a patient, said pump including a RF transmitter and RF receiver for sending and receiving signals from said inclinometer;

Activating said pump and said inclinometer;

Sensing automatically an angle of the head gatch section of the bed frame by said inclinometer;

Sending an RF signal from said pump to said inclinometer when said pump is delivering the liquid nutrient to the patient; and Triggering a means for alerting a medical professional or patient and an operational response when an RF signal from said pump is received by the inclinometer indicating a enteral pump is delivering the liquid nutrient and the angle sensed by the inclinometer is positioned outside a predetermined range.

11. The method of claim 10, wherein said operational response includes shutting off pump when RF signal from said inclinometer indicates the angle sensed by the inclinometer is positioned outside the predetermined range.

12. The system of claim 10, wherein said operational response is an RF signal sent from said inclinometer to said pump instructing said pump to shut off.

13. The system of claim 10, wherein said operational response is an RF signal sent from said pump to said inclinometer instructing said inclinometer to shut off.

14. The method of claim 10, wherein the means for alert is indicating the operational status of said pump, said inclinometer, or both on a display.

15. The method of claim 10, wherein the means for alert is triggering an alarm in communication with said pump, said inclinometer, or both.

16. The method of claim 10, further comprising:

Turning off said alarm when RF signal from said pump to said inclinometer indicates that said pump is not delivering a liquid nutrient.

17. The method of claim 10, further comprising:

Turning off said alarm when said inclinometer senses that said head gatch section is within the predetermined range.

18. The method of claim 10, further comprising:

Turning on said pump when RF signal from said inclinometer to said pump indicates that said head gatch section is positioned within the predetermined range.

19. The method of claim 10, wherein activating the inclinometer is manually performed by switching power on.

20. The method of claim 10, wherein activating the inclinometer is automatically performed when an RF signal is received from said pump indicating that said pump is delivering liquid nutrients to said patient.

21. The method of claim 10, wherein activating the pump is manually performed by turning power on.

22. The method of claim 10, wherein activating the pump is automatically performed when an RF signal from said inclinometer indicates that said head gatch section is within the predetermined angular range.

* * * * *